United States Patent [19]

Archenholtz

[11] 4,244,562

[45] Jan. 13, 1981

[54] POWDER INJECTION APPARATUS FOR INJECTION OF POWDER INTO MOLTEN METAL

[75] Inventor: Åke Archenholtz, Vesteras, Sweden

[73] Assignee: ASEA Aktiebolag, Vesteras, Sweden

[21] Appl. No.: 970,803

[22] Filed: Dec. 18, 1978

[30] Foreign Application Priority Data

Dec. 23, 1977 [SE] Sweden ..... 7714717

[51] Int. Cl.[3] ..... C21C 7/00

[52] U.S. Cl. ..... 266/216; 266/225; 406/109; 75/53

[58] Field of Search ..... 266/182, 216, 265–270, 266/225; 222/145; 75/52–58, 130 BB, 130 C; 164/57–59; 406/109

[56] References Cited

U.S. PATENT DOCUMENTS

| | | | |
|---|---|---|---|
| 2,858,125 | 10/1958 | Clenny et al. | 266/216 |
| 3,069,205 | 12/1962 | McIver et al. | 406/109 |
| 3,801,084 | 4/1974 | Leroy et al. | 266/268 |
| 4,010,938 | 3/1977 | Crudup | 266/216 |
| 4,150,769 | 4/1979 | James | 222/145 |

OTHER PUBLICATIONS

Perry, J. H., ed.; *Chemical Engineers' Handbook,* 4th Edition; McGraw-Hill Book Co., N.Y., pp. 6–29 (1963).

*Primary Examiner*—L. Dewayne Rutledge
*Assistant Examiner*—Michael L. Lewis
*Attorney, Agent, or Firm*—Watson, Cole, Grindle & Watson

[57] ABSTRACT

A lance is removably mounted in a powder container for injecting powder into molten metal within a furnace. The unitary connection of the lance and powder container enables vertical transport of powder as the unit is raisable and lowerable with respect to an opening in the furnace. The powder container can be filled by evacuating it and sucking powder therein. An ejector tube including a cut-off valve maintains the lance opening free from melt when the lance is immersed in the molten metal with no powder injection taking place. A hydraulic cylinder may be used to operate the ejector tube and the cut-off valve. The application of weights enables the container to maintain contact with the furnace roof.

8 Claims, 3 Drawing Figures

POWDER INJECTION APPARATUS FOR INJECTION OF POWDER INTO MOLTEN METAL

BACKGROUND OF THE INVENTION

1. Field Of The Invention

The present invention relates to injection apparatus for injecting powder into a molten metal, and more particularly to such apparatus comprising a container for powder and an injection lance.

2. Prior Art

One problem in connection with prior devices of the above kind has been how to achieve a uniform, pulse-free and safe supply of powder, alloying additives, refining agents, charging powder and or reducing agents to the melt. Sometimes environmental problems in the form of dust formation and clogging have also arisen.

SUMMARY OF THE INVENTION

The invention aims to provide a solution to the problems mentioned above as well as other problems associated therewith, the invention being characterized in that the lance and the powder container are connected together into one unit which is raisable and lowerable relative to the melt (which is to be further charged, supplied with alloying additives, refined, decarburized and/or reduced). This results in short transport paths for the melt, and it is easy to effect a uniform, efficient and easily controllable injection, for example of a furnace such as a channel-type induction furnace through the roof thereof.

BRIEF DESCRIPTION OF THE DRAWINGS

The invention is described and exemplified in more detail in the accompanying Figures, wherein.

DETAILED DESCRIPTION

Figure 1:
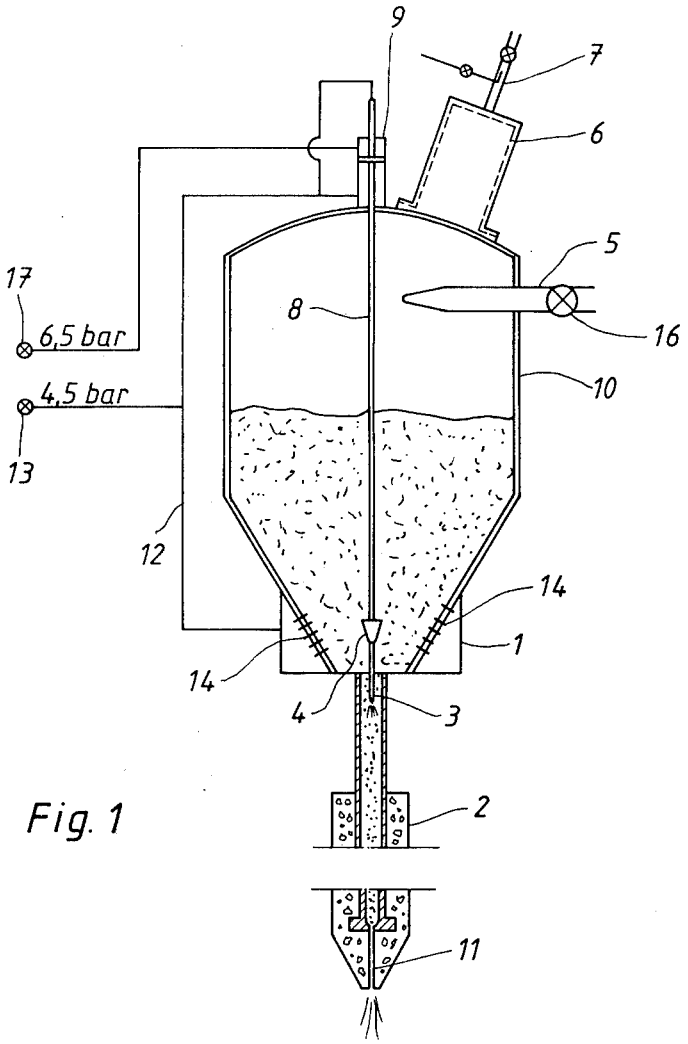
FIG. 1 shows a combined powder container and lance.

FIG. 1 shows powder container 10 which is intended to be built together, suitably detachably connected, with lance 2 provided with a through conduit 11. Lance 2 is used for injection of a powder into a melt while either being immersed, or sometimes not being immersed, in the melt.

Compressed-gas conduit 12, for example emanating from compressed-gas source 13, for example with a pressure 4.5 bar, is connected to fluidizing chamber 1 having injection openings 14 into powder container 10 which is to maintain the powder floating at the point of connection of lance 2.

Lance 2, which is normally immersed into the melt upon injection, is screwed directly to powder container 10. This connection is detachable so that lance 2 can be used separately for injection or blowing in gas in the normal manner.

Figure 2:
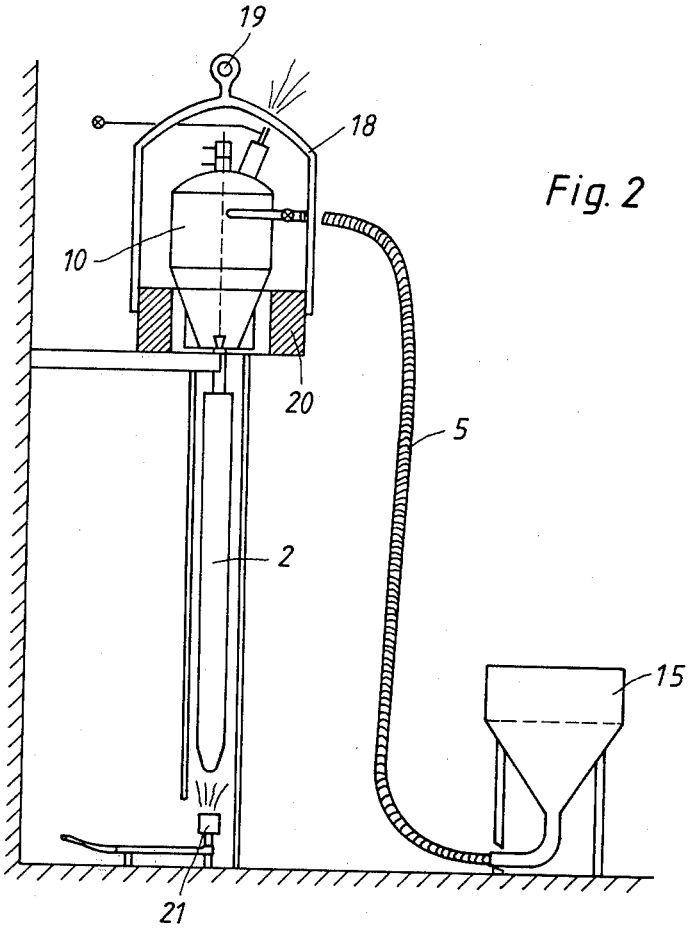
FIG. 2 shows a filling device for powder.

According to FIG. 2, powder is filled from a storage container 15 provided with a sieve, and is connected to powder container 10 through hose or tube 5. The connection of tube 5 to powder container 10 is clear from FIG. 1, in which cut-off valve 16 is also shown. Compressed-air-operated ejector 7 is arranged adjacent to powder container 10 and intended to be used to evacuate the container space. Dust bag 6 is connected to ejector 7 and prevents dust from penetrating into the environment. Lance 2 is connected to through-going tube 8 to provide a separate ejector effect into the lance at point 3. Tube 8 is also connected to cut-off valve 4 to control the flow of powder to lance 2 from powder container 10. Tube 8 with ejector 3 and valve 4 is operable by a hydraulic or pneumatic compressed-air cylinder having continuous piston rod 9. The upper side of rod 9 is connected to pressure medium source 17 with a pressure, for example 6.5 bar, whereas compressed-air source 13 with a lower pressure is connected both to the lower side of the cylnder and to continuous tube 8. Of course, other pressure medium sources can be used as well, for example for the ejector through separate tube 8, i.e. at 3. Valve 4 is closed by applying pressure from pressure source 17 on the upper portion of pneumatic cylinder 9, and when valve 4 is closed compressed-air-operated ejector 7 is operated and a vacuum is formed in powder container 10. Filling tube 5 is opened via valve 16 and the powder is thus rapidly sucked in through the sieve in storage container 15. Dust bag 6 is freed from dust by closing the outlet to ejector 7, which can be done after closing valve 16, or when the powder filling is ended. When powder container 10 is filled with powder, ejector 7 and valve 16 for filling tube 5 are closed. Thereafter a reduced gas pressure is applied to powder container 10 and lance 2 is immersed into the melt.

FIG. 2 shows how powder container 10 with lance 2 has been provided with common yoke 18 and lifting eye bolt 19, which can be attached, for example, to a travelling crane. At the lower portion of yoke 18 there are arranged weights 20, the function of which will be described hereinafter. During the preparatory procedure, preheating and drying of lance 2 is obtained by burner 21. Raising and lowering of lance 2 up from and down into the melt take place by lifting eye bolt 19 with the travelling crane.

While lance 2 is immersed into the melt and before valve 4 has been opened, lance hole 11 is maintained free of melt by operation of ejector 3. Thereafter pressure cylinder 9 is relieved on the upper side, valve 4 thus opening and powder is blown out through lance 2 at nozzle 11. After injection is finished, valve 4 is closed again by applying a pressure on the upper side, and lance 2 is pulled up by means of the travelling crane according to FIG. 2. During the whole injection process, the powder close to the lance opening is kept fluidized by blowing in gas from pressure medium source 13, and it should be noted that the pressure therein is lower than the pressure from pressure medium source 17. When valve 4 is to be opened, the pressure on the upper side of hydraulic cylinder 9 is removed and the pressure from pressure medium source 13 raises tube 8 along with valve 4 and ejector 3.

Figure 3:
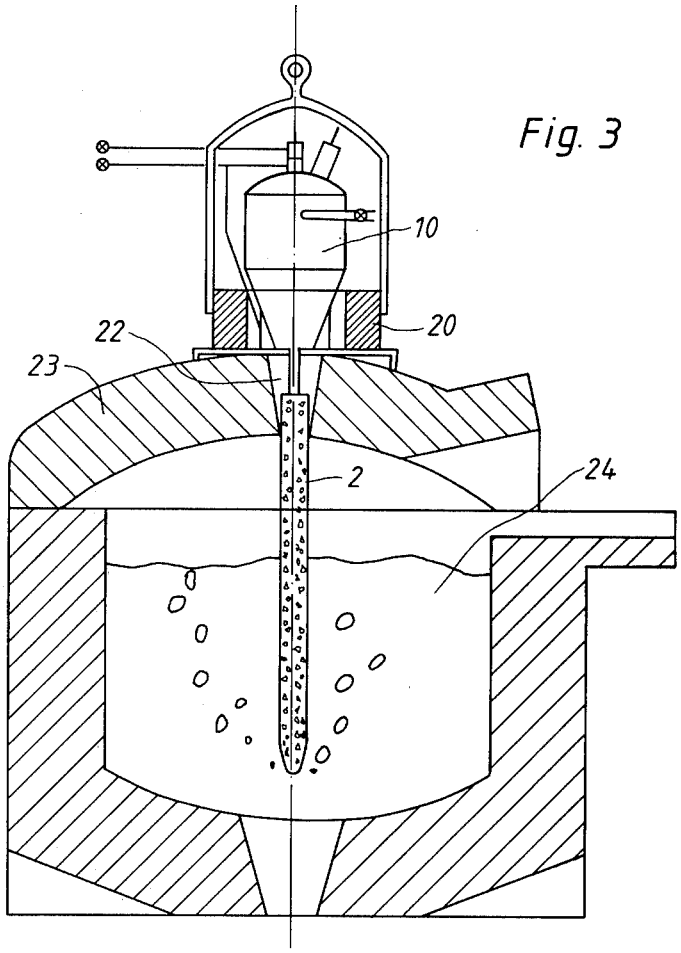
FIG. 3 illustrates the powder injection apparatus applied to a furnace.

FIG. 3 shows powder container 10 with lance 2 in operative association with a furnace. Container 10 with lance 2 is weighted by weights 20 to through-hole 22 in roof 23 of a channel-type induction furnace or any other type of furnace. The function of weights 20 is of course to press down powder container 10 with lance 2 against roof opening 22, and as can be seen, lance 2 is immersed into melt 24 during the injection process. It is, of course, also possible to blow gas through powder container 10 into melt 24 in the usual manner, and also possibly after removing powder container 10. The aforedescribed operation can be applied to all types of furnaces and metallurgical containers without departing from the principle of the invention. Cylinder 9 can also be operated from other pressure medium sources (not shown).

The invention as described herein can be used in connection with charging, alloying additives, refining, decarburizing and/or reduction of a melt for all kinds of metals, and also in connection with steel.

What is claimed is:

1. Means for injection of powder into a molten metal, comprising:

a container for retaining powder;

a lance mounted to said container for injection of powder into the molten metal;

powder storage means connected to said contaIner;

evacuation means connected to said container for evacuating said container for ejector filling thereof with powder;

an ejector tube mounted within said container and movable in said lance in proximity to the opening thereof for ejecting gas therein to maintain the lance opening free of melt with the lance immersed therein; and means for moving said ejector tube in said lance.

2. Means according to claim 1, further comprising a cut-off valve for the lance connected to said ejector tube, said cut-off valve being designed to open and close the transport of powder through said lance.

3. Means according to claim 2, further comprising means for operating said cut-off valve.

4. Means according to claim 2, wherein said means for moving is a hydraulic cylinder.

5. Means according to claim 1, further comprising weights mounted to said container for maintaining contact with an opening in a furnace roof.

6. Means according to claim 1, wherein said lance and the container being assembled for vertical powder transport and being raisable and lowerable in relation to the melt.

7. Means according to claim 1 wherein said evacuation means includes an evacuation pump orifice located in a lid of said container.

8. Means according to claim 7 wherein said evacuation means includes a dust bag sealingly engaged with said lid around said evacuation pump orifice for preventing powder or dust from escaping said powder container through said evacuation pump orifice.

* * * * *